US006084550A

United States Patent [19]

Jones

[11] Patent Number: 6,084,550

[45] Date of Patent: Jul. 4, 2000

[54] MOUNTABLE SENSOR HOUSING FOR A HEATED ANTENNA REFLECTOR

[75] Inventor: Thaddeus M. Jones, Bremen, Ind.

[73] Assignee: MSX, Inc., South Bend, Ind.

[21] Appl. No.: 09/251,362

[22] Filed: Feb. 17, 1999

[51] Int. Cl.[7] ..... H01Q 1/02

[52] U.S. Cl. ..... 343/704; 392/422

[58] Field of Search ..... 343/704, 912, 343/840; 392/420, 422, 431, 426; H01Q 1/02

[56] References Cited

U.S. PATENT DOCUMENTS 4,506,265 3/1985 Dumas et al. ..... 343/704
5,010,350 4/1991 Lipkin et al. ..... 343/704
5,729,238 3/1998 Walton, Jr. ..... 343/704

*Primary Examiner*—Hoanganh Le
*Attorney, Agent, or Firm*—Taylor & Aust, P. C.

[57] ABSTRACT

An antenna reflector assembly includes a reflector, a heater for heating the reflector, and a support arm connected to the reflector. The support arm has a range of directional orientations. A sensor housing is connected to the support arm. The sensor housing includes a tube having a substantially vertical orientation and a mounting device configured for at least indirectly carrying the tube. The mounting device is configured for being connected to the support arm such that the tube can be maintained in the substantially vertical orientation throughout the range of directional orientations of the support arm. At least one sensor is disposed within the tube.

12 Claims, 2 Drawing Sheets

MOUNTABLE SENSOR HOUSING FOR A HEATED ANTENNA REFLECTOR

BACKGROUND OF THE INVENTION

1. Field of the Invention

The present invention relates to antenna reflectors, and, more particularly, heated antenna reflectors.

2. Description of the Related Art

A reflector, commonly called a dish, is generally a parabolic section having a round, elliptical or other configuration. A reflector functions to gather radio or microwave frequency energy transmitted from the feedhorn or through the ambient environment from an external transmitter. The reflector can thus be used to receive and transmit signals to and from the satellite system. Most satellites are in equatorial orbit. Thus, it is necessary to adjust the direction angle at which the reflector faces, depending upon the latitude of the earth station location. At least some of the support structure of the reflector, such as a support arm which supports the feedhorn, is rigidly attached to the reflector such that the angle between the support arm and the horizon also varies with the latitude of the earth station location.

Reflectors are usually located outdoors, where snow and ice may collect on the receiving or concave side, degrading the performance of the reflector. To prevent such accumulation of ice and snow on the reflecting surface, electrical heaters are used to heat at least the lower part of the reflecting surface. In order to minimize the power used to keep the reflecting surface clear of ice and snow, a control device can be used to activate the heater only when it is needed. The control device can include a temperature sensor and a moisture sensor which together sense the presence of frozen precipitation and send a signal to an electrical processor to activate the heater.

The moisture sensor is typically attached to the support arm of the reflector. This mounting location has the advantage of being in close proximity to the reflecting surface in order to accurately sense the environmental conditions to which the reflecting surface is exposed. Also, the moisture sensor, when mounted to the support arm, is not excessively shielded by the reflector. A problem with mounting the moisture sensor on the support arm is that the sensing grid of the moisture sensor must be kept substantially horizontal in order to most effectively sense the presence of snow. However, as described above, the angular orientation of the support arm is variable. Thus, the variable angular orientation of the support arm creates difficulties in mounting the moisture sensor such that the sensor grid is kept horizontal.

Another problem is that the decision to install a heater and its associated sensors must be made before manufacture of the reflector. Often this decision must be made before knowing the latitudinal position at which the reflector will be located.

What is needed in the art is a sensor assembly which can be installed on the support arm of a heated antenna reflector such that the presence of snow can be effectively sensed, regardless of the angular orientation of the support arm.

SUMMARY OF THE INVENTION

The present invention provides a sensor assembly including a moisture sensor that can be easily mounted on a support arm of a heated antenna reflector such that the sensor grid of the moisture sensor can be kept substantially horizontal regardless of the angular orientation of the support arm.

The invention comprises, in one form thereof, an antenna reflector assembly including a reflector, a heater for heating the reflector, and a support arm connected to the reflector. The support arm has a range of directional orientations. A sensor housing is connected to the support arm. The sensor housing includes a tube having a substantially vertical orientation and a mounting device configured for at least indirectly carrying the tube. The mounting device is configured for being connected to the support arm such that the tube can be maintained in the substantially vertical orientation throughout the range of directional orientations of the support arm. At least one sensor is disposed within the tube.

An advantage of the present invention is that the sensor grid of the moisture sensor can be kept substantially horizontal regardless of the angular orientation of the support arm to which it is mounted.

Another advantage is that snow can be efficiently collected on the sensor grid, even under windy conditions.

Yet another advantage is that water from melted snow is prevented from accumulating on the sensor grid.

A further advantage is that the sensor can be mounted such that a range of support arm angular orientations is accommodated. Thus, it is unnecessary to determine the intended final latitudinal position of the antenna reflector before it is manufactured.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
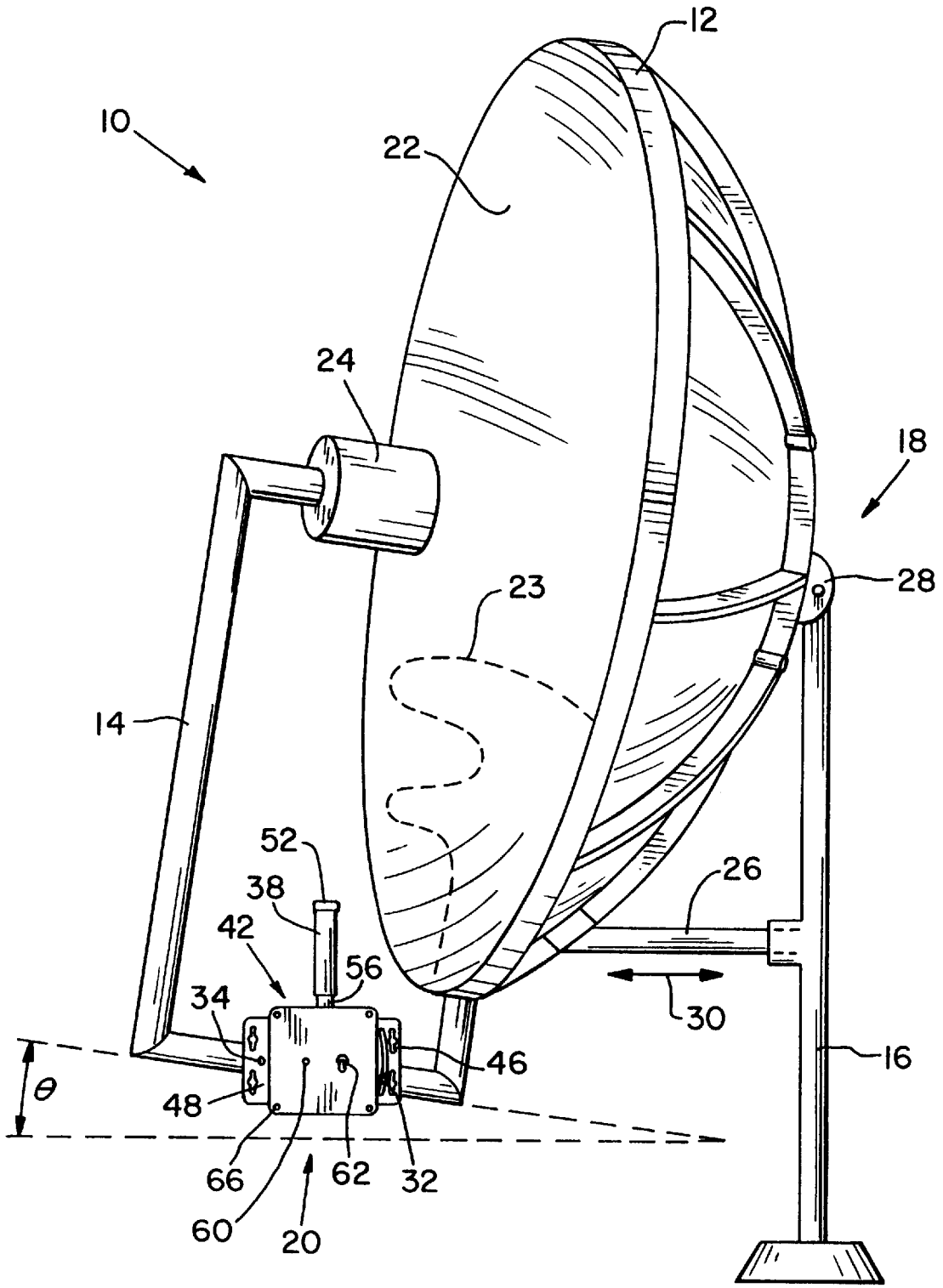
FIG. 1 is a perspective view of one embodiment of a antenna reflector assembly of the present invention.

Referring now to the drawings, and more particularly to FIG. 1, there is shown an antenna reflector assembly 10 including a reflector 12, a support arm 14, a support post 16, an angular adjustment mechanism 18 and a sensor assembly 20.

Reflector 12 includes a reflecting surface 22 that is heated by an electrical heater 23 to prevent the accumulation of ice and snow, thereby ensuring optimum performance. Reflecting surface 22 reflects radio or microwave frequency energy transmitted from a feedhorn 24 or another external source. Feedhorn 24 can also include an electrical heater (not shown) to prevent the accumulation of ice and snow.

Support arm 14 rigidly interconnects reflector 12 and feedhorn 24 in order to maintain a fixed spatial relationship therebetween. Support post 16 supports and positions reflector 12 approximately between three and four feet above the ground in order to avoid interference from objects near the ground.

Angular adjustment mechanism 18 is used to adjust the angular orientation of reflector 12 with respect to the horizon. Since reflector 12 should be directed towards satellites which orbit the equator of the earth, the desired angular orientation of reflector 12 depends upon the geographic latitudinal position of reflector 12. Angular adjustment mechanism 18 includes a telescoping extension arm 26 and a pivotal connection 28, each of which interconnects reflector 12 with support post 16. Reflector 12 pivots about pivotal connection 28 while extension arm 26 moves a lower portion of reflector 12 in either direction indicated by double arrow 30. The power to move extension arm 26 may be provided by substantially any method, including hydraulically, manually, or with a motorized actuator.

As the angular orientation of reflector 12 is adjusted, so too is the directional orientation of support arm 14 relative to the horizon, as indicated by angle θ. Since support arm 14 is rigidly attached to reflector 12, the angular orientation of support arm 14 follows the changes in the angular orientation of reflector 12.

Figure 2:
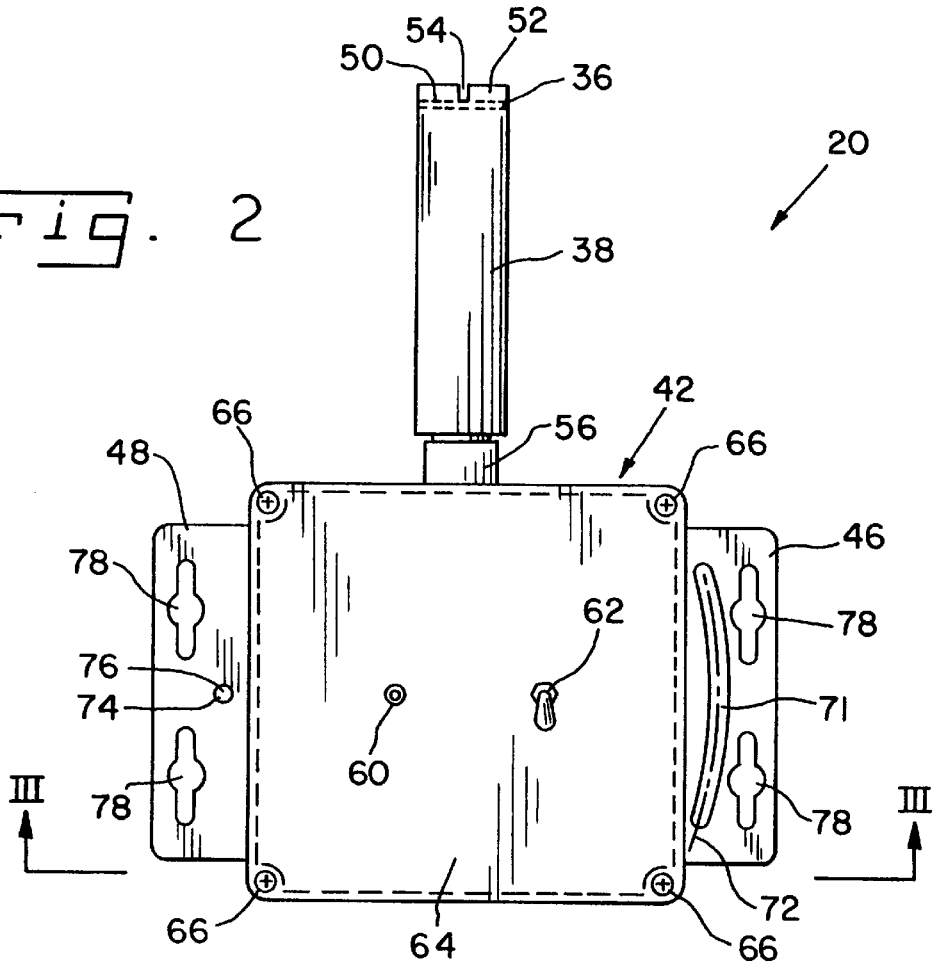
FIG. 2 is a front view of one embodiment of a sensor assembly of the antenna reflector assembly of FIG. 1.
Figure 3:
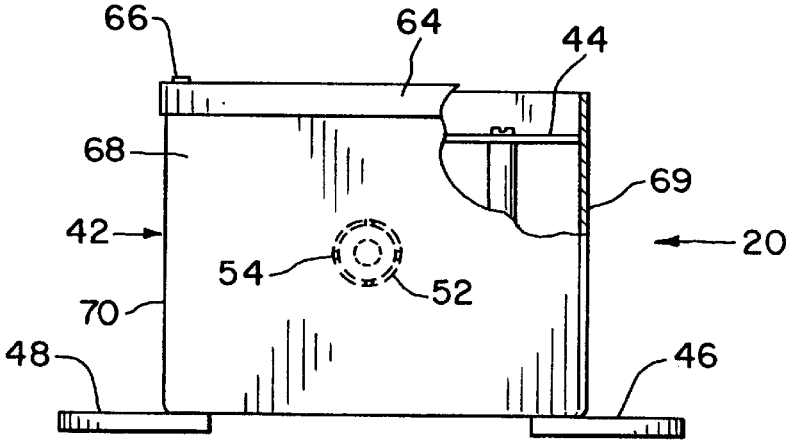
FIG. 3 is a fragmentary, sectional, bottom view of the sensor assembly of FIG. 2 taken along line III—III.

Fastening devices 32 and 34, in the form of bolts, rigidly attach sensor assembly 20, best seen in FIGS. 2 and 3, to support arm 14. Sensor assembly 20 includes a moisture sensor 36, a tube 38, a housing 42, an interior panel 44, and mounting brackets 46 and 48.

Moisture sensor 36 includes a sensor grid represented schematically in FIG. 2 by dashed lines. Moisture sensor 36 uses an on-board temperature regulated heater (not shown) to convert snow and/or ice to liquid water. Water on a surface 50 of the sensing grid is detected as a change in conductivity. In order to maintain the water on surface 50 for a length of time sufficient for it to be detected, surface 50 must be kept substantially horizontal. An interface circuit (not shown) incorporated within moisture sensor 36 converts the conductivity change into a low-impedance analog signal.

Tube 38 encloses moisture sensor 36 and a temperature sensor (not shown). Since surface 50 of moisture sensor 36 must be kept substantially horizontal, as discussed above, tube 38 must be kept in a substantially vertical orientation. A wind shield 52 at the top end of tube 38 substantially surrounds moisture sensor grid 36, thus ensuring good snow collection efficiency in windy conditions. Vertical drain slots 54 allow excess water from the snow melted on grid 36 to flow down the outside of tube 38, thus preventing the water from accumulating on grid 36. Such accumulated water on grid 36 could possibly cause grid 36 to give a false indication of snow. Drain slots 54 extend downwardly at least to a vertical level that is at or slightly below surface 50 of moisture grid 36. Thus, moisture grid 36 is disposed adjacent to drain slots 54.

Housing 42 includes a threaded boss 56 for convenient attachment of tube 38. Housing 42 contains an interior panel 44 which serves as a safety barrier that prevents operating personnel from coming into contact with line voltage wiring. Interior panel 44 also has a printed circuit board (not shown) attached thereon. The printed circuit board includes an electrical processor (not shown) which receives, through tube 38, the signals transmitted from moisture sensor 36 and the temperature sensor. Based upon these received signals, the electrical processor controls the operation of the electrical heater(s) for reflector 12 and/or feedhorn 24. The printed circuit board also includes a front face having a status indicator, which is in the form of a lamp 60, and a test switch 62. Each of lamp 60 and test switch 62 is electrically connected to the electrical processor. Status indicator 60 can be used, for example, to indicate whether the electrical heaters are operating, or to indicate whether voltage is available for the operation of the electrical heaters. Test switch 62 can be used, for example, to bypass the signals sent by moisture sensor 36 and the temperature sensor and thereby operate the electrical heaters for testing regardless of the current ambient moisture or temperature conditions.

Housing 42 also includes a front cover 64 formed of a transparent, fire retardant and ultraviolet resistant material such as a polycarbonate resin. Operation of status indicator 60 can be observed through the transparent front cover 64. Accessing test switch 62 requires removing four screws 66 attaching front cover 64 to a body 68 of housing 42. A gasket (not shown) is disposed between front cover 64 and a body 68 in order to provide moisture protection.

Mounting brackets or flanges 46 and 48 are rigidly attached to rear portions of respective opposite sides 69 and 70 of housing 42. Mounting brackets 46, 48 are used to mount housing 42 to support arm 14. A first mounting bracket 46 includes an arcuate slot 71 therethrough which defines a circle 72, a portion of which is represented by the dashed arc in FIG. 2. A second mounting bracket 48 includes a through hole 74 positioned concentric with a center 76 of circle 72. A first fastening device 32 extends through arcuate slot 71 into support arm 14, while a second fastening device 34 extends through through hole 74 into support arm 14. With first fastening device 32 attached to support arm 14 and loosely retained within arcuate slot 71, sensor assembly 20 can be pivoted about second fastening device 34 such that first fastening device 32 travels along and relative to arcuate slot 71. Thus, sensor assembly 20 can be pivoted to a position whereat tube 38 is substantially vertical and sensor surface 50 is substantially horizontal. First fastening device 32 can then be tightened to securely clamp first mounting bracket 46 in this position.

Arcuate slot 71 is of a sufficient length that tube 38 can be maintained in its vertical orientation throughout the range of directional orientations of support arm 14. Arcuate slot 71 can be of a length such that the range of mounting angles of housing 42 is greater than the range of orientation angles of reflector 12 and support arm 14.

Of course, if support arm 26 is moved to another angular orientation, it is possible to loosen first fastening device 32 and again rotate sensor assembly 20 about second fastening device 34 until tube 38 is substantially vertical. First fastening device 32 can then again be tightened in order to securely fix the position of sensor assembly 20 relative to support arm 14.

When sensor assembly 20 can be attached to a larger mounting surface (not shown), and particularly a mounting surface that does not rotate, it is possible to fasten brackets 46, 48 to the mounting surface through mounting holes 78.

Housing 42, tube 38 and mounting brackets 46, 48 are shown in the embodiment as having particular geometric shapes. However, it is to be understood that any of these components can also have various other shapes. Moreover, it is possible for brackets 46, 48 to be integrated into a single, unitary device including housing 42 and/or tube 38.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An antenna reflector assembly, comprising:

a reflector;

a support arm connected to said reflector, said support arm having a range of directional orientations;

a heater configured for heating said reflector;

a sensor housing connected to said support arm, said sensor housing including:

a tube having a substantially vertical orientation; and a mounting device configured for at least indirectly carrying said tube, said mounting device being configured for being connected to said support arm such that said tube can be maintained in said substantially vertical orientation throughout said range of directional orientations of said support arm; and at least one sensor disposed within said tube and electrically connected to said heater.

2. The antenna reflector assembly of claim 1, wherein said mounting device includes an arcuate slot configured for receiving a first fastening device.

3. The antenna reflector assembly of claim 2, wherein said arcuate slot defines a range of housing mounting angles, said range of directional orientations of said support arm defining a range of reflector orientation angles, said range of housing mounting angles being one of greater than and equal to said range of reflector orientation angles.

4. The antenna reflector assembly of claim 2, wherein said arcuate slot defines a circle, said mounting device including a through hole disposed approximately at a center of said circle, said through hole being configured for receiving a second fastening device.

5. The antenna reflector assembly of claim 1, wherein said tube has a top end, said tube including at least one wind shield at said top end, said at least one wind shield defining at least one drain opening.

6. The antenna reflector assembly of claim 5, wherein said at least one drain opening comprises at least one substantially vertical drain slot.

7. The antenna reflector assembly of claim 5, wherein said at least one sensor includes a moisture sensor having a moisture grid, said moisture grid being disposed adjacent to said at least one drain opening.

8. The antenna reflector assembly of claim 1, wherein said reflector includes a feedhorn.

9. An antenna reflector assembly, comprising:

a reflector device having a range of directional orientations, said reflector device including:

a reflector; and a support arm connected to said reflector;

a sensor housing connected to one of said support arm and said reflector, said sensor housing including:

a tube having a substantially vertical orientation; and a mounting device configured for at least indirectly carrying said tube, said mounting device being configured for being connected to one of said reflector and said support arm such that said tube can be maintained in said substantially vertical orientation throughout said range of directional orientations of said reflector device; and at least one sensor disposed within said tube.

10. A sensor assembly for mounting to a support arm of a heated antenna reflector assembly, comprising:

a tube having a substantially vertical orientation;

at least one sensor disposed within said tube;

a housing carrying said tube, said housing having a first side and a second side disposed opposite said first side;

at least one electrical device disposed within said housing, said at least one electrical device being electrically connected to said at least one sensor through said tube;

at least two mounting brackets, a first said mounting bracket being attached to said first side of said housing, a second said mounting bracket being attached to said second side of said housing, said first mounting bracket including an arcuate slot defining a circle, said second mounting bracket including a through hole disposed approximately at a center of said circle; and at least two fastening devices, each said fasting device being configured for fastening an associated said mounting bracket to the support arm of the reflector assembly, a first said fastening device being received in said arcuate slot of said first mounting bracket, a second said fastening device being received in said through hole of said second mounting device.

11. The sensor assembly of claim 10, wherein said first fastening device and said arcuate slot define a means for allowing said sensor assembly to pivot about said second fastening device.

12. The sensor assembly of claim 10, wherein said housing includes at least one of a display connected to said at least one electrical device and a control connected to said at least one electrical device.

* * * * *